US007306471B2

(12) United States Patent
Shau-din

(10) Patent No.: US 7,306,471 B2
(45) Date of Patent: Dec. 11, 2007

(54) UNIVERSAL POWER PLUG WITH ADJUSTABLE ROTATING BODIES

(76) Inventor: Chow Shau-din, 25B/F, 31 Wharfroad, North Point (HK)

( * ) Notice: Subject to any disclaimer, the term of this patent is extended or adjusted under 35 U.S.C. 154(b) by 0 days.

(21) Appl. No.: 11/471,851

(22) Filed: Jun. 20, 2006

(65) Prior Publication Data

US 2007/0019422 A1 Jan. 25, 2007

Related U.S. Application Data

(60) Provisional application No. 60/701,741, filed on Jul. 22, 2005.

(51) Int. Cl.
*H01R 29/00* (2006.01)

(52) U.S. Cl. ..... 439/171; 439/11; 439/104

(58) Field of Classification Search ..... 439/171, 439/11, 31, 6, 104, 105, 174, 173, 170
See application file for complete search history.

(56) References Cited

U.S. PATENT DOCUMENTS 5,716,219 A * 2/1998 Noike ..... 439/31
6,790,086 B1 * 9/2004 Lo ..... 439/599
7,052,298 B1 * 5/2006 Cheng ..... 439/171

* cited by examiner

*Primary Examiner*—Hae Moon Hyeon
(74) *Attorney, Agent, or Firm*—GSS Law Group

(57) ABSTRACT

A universal power plug comprises two plastic halves that are hinged together so they can open and close like a door hinge plate. Each half has a plug blade mounted in a cylindrical socket that allows them to freely rotate and best fit a particular wall socket. The hinged arrangement allows the pitch between the blades to be adjusted to accommodate the variety of blade and pin spacings used throughout the world for power plugs. A spring is provided between the housing halves to put pressure between the plug blades and a receptacle's contacts when the housing halves are folded close together.

7 Claims, 3 Drawing Sheets

402
contact
detail
412
414
416
400
406
P
408
410
404
UK type BS-1363 receptacle

UNIVERSAL POWER PLUG WITH ADJUSTABLE ROTATING BODIES

This application claims the benefit of the priority date of provisional patent application Ser. No. 60/701,741 filed on Jul. 22, 2005.

FIELD OF THE INVENTION

The present invention relates to utility power cords and plugs, and in particular to universal power plugs and cords that adapt to the variety of configurations used throughout the world.

BACKGROUND

The are at least twelve different and incompatible styles of power plugs and sockets in use throughout the world today. These are represented in FIGS. 1A-1M. Table I summarizes which ones are in use in various countries, and the voltage and line frequencies used there. Voltages span 110V to 240V, and line frequencies are either 50 Hz or 60 Hz. Two and sometimes three pins or blades are used, and the size and position of the pins and blades vary with each type. The third electrode is usually a ground used in three-wire systems.

Modern electronic appliances are able to operate automatically with any of these voltages and frequencies, it's the plug arrangements that give trouble. But, larger appliances with motors must be operated with only one choice, 110V or 220V, and 50 Hz or 60 Hz. The United States is a rather large area that agrees all on the same style, FIGS. 1A-1B, so getting the correct plug is not usually a problem with 110V appliances. Dryers and other 220V appliances in the US do have a variety of incompatible plugs that are intended to match the current ratings, e.g., 30 A or 50 A. International travelers, and purchasers of international products are the ones who frequently must deal with power plug incompatibilities.

TABLE I

| COUNTRY | VOLTAGE | FREQUENCY | PLUG |
|---|---|---|---|
| Afghanistan | 220 V | 50 Hz | FIG. 1C, FIG. 1F |
| Albania | 220 V | 50 Hz | FIG. 1C, FIG. 1F |
| Algeria | 230 V | 50 Hz | FIG. 1C, FIG. 1F |
| American Samoa | 120 V | 60 Hz | FIG. 1A, FIG. 1B, FIG. 1F, FIG. 1I |
| Andorra | 230 V | 50 Hz | FIG. 1C, FIG. 1F |
| Angola | 220 V | 50 Hz | FIG. 1C |
| Anguilla | 110 V | 60 Hz | FIG. 1A (maybe FIG. 1B) |
| Antigua | 230 V | 60 Hz | FIG. 1A, FIG. 1B |
| Argentina | 220 V | 50 Hz | FIG. 1C, FIG. 1I |
| Armenia | 220 V | 50 Hz | FIG. 1C, FIG. 1F |
| Aruba | 127 V | 60 Hz | FIG. 1A, FIG. 1B, FIG. 1F |
| Australia | 230 V | 50 Hz | FIG. 1I |
| Austria | 230 V | 50 Hz | FIG. 1C, FIG. 1F |
| Azerbaijan | 220 V | 50 Hz | FIG. 1C, FIG. 1F |
| Azores | 220 V | 50 Hz | FIG. 1B, FIG. 1C, FIG. 1F |
| Bahamas | 120 V | 60 Hz | FIG. 1A, FIG. 1B |
| Bahrain | 230 V | 50 Hz | FIG. 1G |
| Awali | 110 V | 60 Hz | FIG. 1G |
| Balearic Islands | 220 V | 50 Hz | FIG. 1C, FIG. 1F |
| Bangladesh | 220 V | 50 Hz | FIG. 1A, FIG. 1C, FIG. 1D, FIG. 1G, FIG. 1K |
| Barbados | 115 V | 50 Hz | FIG. 1A, FIG. 1B |
| Belarus | 220 V | 50 Hz | FIG. 1C, FIG. 1F |
| Belgium | 230 V | 50 Hz | FIG. 1E |
| Belize | 110/220 V | 60 Hz | FIG. 1B, FIG. 1G |
| Benin | 220 V | 50 Hz | FIG. 1E |
| Bermuda | 120 V | 60 Hz | FIG. 1A, FIG. 1B |
| Bhutan | 230 V | 50 Hz | FIG. 1D, FIG. 1F, FIG. 1G FIG. 1M |
| Bolivia | 220/230 V | 50 Hz | FIG. 1A, FIG. 1C |
| Bosnia | 220 V | 50 Hz | FIG. 1C, FIG. 1F |
| Botswana | 231 V | 50 Hz | FIG. 1G, FIG. 1M |
| Brazil | 110/220 V | 60 Hz | FIG. 1A, FIG. 1B, FIG. 1C |
| Brunei | 240 V | 50 Hz | FIG. 1G |
| Bulgaria | 230 V | 50 Hz | FIG. 1C, FIG. 1F |
| Burkina Faso | 220 V | 50 Hz | FIG. 1C, FIG. 1E |
| Burundi | 220 V | 50 Hz | FIG. 1C, FIG. 1E |
| Cambodia | 230 V | 50 Hz | FIG. 1A, FIG. 1C |
| Canada | 120 V | 60 Hz | FIG. 1A, FIG. 1B |
| Canary Islands | 220 V | 50 Hz | FIG. 1C, FIG. 1E, FIG. 1L |
| Cape Verde | 220 V | 50 Hz | FIG. 1C, FIG. 1F |
| Cayman Islands | 120 V | 60 Hz | FIG. 1A, FIG. 1B |
| Central African Rep | 220 V | 50 Hz | FIG. 1C, FIG. 1E |
| Chad | 220 V | 50 Hz | FIG. 1D, FIG. 1E, FIG. 1F |
| Channel Islands | 230 V | 50 Hz | FIG. 1G |
| Chile | 220 V | 50 Hz | FIG. 1C, FIG. 1L |
| China, People's Rep | 220 V | 50 Hz | FIG. 1A, FIG. 1I, FIG. 1G |
| Colombia | 110 V | 60 Hz | FIG. 1A, FIG. 1B |
| Comoros | 220 V | 50 Hz | FIG. 1C, FIG. 1E |
| Congo, People's Rep | 230 V | 50 Hz | FIG. 1C, FIG. 1E |
| Congo, Dem. Rep | 220 V | 50 Hz | FIG. 1C, FIG. 1D |
| Cook Islands | 240 V | 50 Hz | FIG. 1I |
| Costa Rica | 120 V | 60 Hz | FIG. 1A, FIG. 1B |

TABLE I-continued

| COUNTRY | VOLTAGE | FREQUENCY | PLUG |
|---|---|---|---|
| Côte d'Ivoire (Ivory Coast) | 220 V | 50 Hz | FIG. 1C, FIG. 1E |
| Croatia | 230 V | 50 Hz | FIG. 1C, FIG. 1F |
| Cuba | 110/220 V | 60 Hz | FIG. 1A, FIG. 1B, FIG. 1C, FIG. 1F, FIG. 1L |
| Cyprus | 240 V | 50 Hz | FIG. 1G |
| Czech Republic | 230 V | 50 Hz | FIG. 1E |
| Denmark | 230 V | 50 Hz | FIG. 1C, FIG. 1K |
| Djibouti | 220 V | 50 Hz | FIG. 1C, FIG. 1E |
| Dominica | 230 V | 50 Hz | FIG. 1D, FIG. 1G |
| Dominican Republic | 110 V | 60 Hz | FIG. 1A Type FIG. 1J |
| East Timor | 220 V | 50 Hz | FIG. 1C, FIG. 1E, FIG. 1F, FIG. 1I, |
| Ecuador | 120–127 V | 60 Hz | FIG. 1A, FIG. 1B |
| Egypt | 220 V | 50 Hz | FIG. 1C |
| El Salvador | 115 V | 60 Hz | FIG. 1A–1G, FIGS. 1I–1L |
| Equatorial Guinea | 220 V | 50 Hz | FIG. 1C, FIG. 1E |
| Eritrea | 230 V | 50 Hz | FIG. 1C |
| Estonia | 230 V | 50 Hz | FIG. 1F |
| Ethiopia | 220 V | 50 Hz | FIG. 1D, FIG. 1J, FIG. 1L |
| Faeroe Islands | 220 V | 50 Hz | FIG. 1C, FIG. 1K |
| Falkland Islands | 240 V | 50 Hz | FIG. 1G |
| Fiji | 240 V | 50 Hz | FIG. 1I |
| Finland | 230 V | 50 Hz | FIG. 1C, FIG. 1F |
| France | 230 V | 50 Hz | FIG. 1E |
| French Guiana | 220 V | 50 Hz | FIG. 1C, FIG. 1E |
| Gaza | 230 V | 50 Hz | FIG. 1H |
| Gabon | 220 V | 50 Hz | FIG. 1C |
| Gambia | 230 V | 50 Hz | FIG. 1G |
| Germany | 230 V | 50 Hz | FIG. 1C, FIG. 1F |
| Ghana | 230 V | 50 Hz | FIG. 1D, FIG. 1G |
| Gibraltar | 240 V | 50 Hz | FIG. 1C, FIG. 1G |
| Greece | 220 V | 50 Hz | FIG. 1C, FIG. 1D, FIG. 1E, FIG. 1F |
| Greenland | 220 V | 50 Hz | FIG. 1C, FIG. 1K |
| Grenada | 230 V | 50 Hz | FIG. 1G |
| Guadeloupe | 230 V | 50 Hz | FIG. 1C, FIG. 1D, FIG. 1E |
| Guam | 110 V | 60 Hz | FIG. 1A, FIG. 1B |
| Guatemala | 120 V | 60 Hz | FIG. 1A, FIG. 1B, FIG. 1G, FIG. 1I |
| Guinea | 220 V | 50 Hz | FIG. 1C, FIG. 1F, FIG. 1K |
| Guinea-Bissau | 220 V | 50 Hz | FIG. 1C |
| Guyana | 240 V | 60 Hz | |
| Haiti | 110 V | 60 Hz | FIG. 1A, FIG. 1B |
| Honduras | 110 V | 60 Hz | FIG. 1A, FIG. 1B |
| Hong Kong | 220 V | 50 Hz | FIG. 1G, FIG. 1M |
| Hungary | 230 V | 50 Hz | FIG. 1C, FIG. 1F |
| Iceland | 220 V | 50 Hz | FIG. 1C, FIG. 1F |
| India | 230 V | 50 Hz | FIG. 1C, FIG. 1D |
| Indonesia | 127/230 V | 50 Hz | FIG. 1C, FIG. 1F, FIG. 1G |
| Iran | 230 V | 50 Hz | FIG. 1C |
| Iraq | 230 V | 50 Hz | FIG. 1C, FIG. 1D, FIG. 1G |
| Ireland (Eire) | 230 | 50 Hz | FIG. 1G Type FIG. 1F |
| Isle of Man | 240 V | 50 Hz | FIG. 1C, FIG. 1G |
| Israel | 230 V | 50 Hz | FIG. 1H, FIG. 1C |
| Italy | 230 V | 50 Hz | FIG. 1C, FIG. 1F, FIG. 1L Type FIG. 1L |
| Jamaica | 110 V | 50 Hz | FIG. 1A, FIG. 1B |
| Japan | 100 V | 50/60 Hz | FIG. 1A, FIG. 1B |
| Eastern Japan | 50 Hz | | (Tokyo, Kawasaki, Sapporo, Yokohoma, and Sendai) |
| Western Japan | 60 Hz | | (Osaka, Kyoto, Nagoya, Hiroshima) |
| Jordan | 230 V | 50 Hz | FIG. 1D, FIG. 1F, FIG. 1G, FIG. 1J Type FIG. 1C |
| Kenya | 240 V | 50 Hz | FIG. 1G |
| Kazakhstan | 220 V | 50 Hz | FIG. 1C |
| Kiribati | 240 V | 50 Hz | FIG. 1I |
| Korea, South | 220 V | 60 Hz | FIG. 1C, FIG. 1F |
| Kuwait | 240 V | 50 Hz | FIG. 1C, FIG. 1G |
| Laos | 230 V | 50 Hz | FIG. 1A, FIG. 1B, FIG. 1C, FIG. 1E, FIG. 1F |
| Latvia | 220 V | 50 Hz | FIG. 1C, FIG. 1F |
| Lebanon | 110/220 V | 50 Hz | FIG. 1A, FIG. 1B, FIG. 1C, FIG. 1D, FIG. 1G |
| Lesotho | 220 V | 50 Hz | FIG. 1M |
| Liberia | 120 V | 60 Hz | FIG. 1A, FIG. 1B |
| Libya | 127 V | 50 Hz | FIG. 1D |
| Lithuania | 220 V | 50 Hz | FIG. 1C, FIG. 1F |
| Liechtenstein | 230 V | 50 Hz | FIG. 1J |
| Luxembourg | 220 V | 50 Hz | FIG. 1C, FIG. 1F |
| Macau | 220 V | 50 Hz | FIG. 1D, FIG. 1G |
| Macedonia | 220 V | 50 Hz | FIG. 1C, FIG. 1F |
| Madagascar | 220 V | 50 Hz | FIG. 1C, FIG. 1E |
| Madeira | 220 V | 50 Hz | FIG. 1C, FIG. 1F |
| Malawi | 230 V | 50 Hz | FIG. 1G |
| Malaysia | 240 V | 50 Hz | FIG. 1G |
| Maldives | 230 V | 50 Hz | FIG. 1A, FIG. 1D, FIG. 1G, FIG. 1J, FIG. 1K, FIG. 1L |

TABLE I-continued

| COUNTRY | VOLTAGE | FREQUENCY | PLUG |
|---|---|---|---|
| Mali | 220 V | 50 Hz | FIG. 1C, FIG. 1E |
| Malta | 240 V | 50 Hz | FIG. 1G |
| Martinique | 220 V | 50 Hz | FIG. 1C, FIG. 1D, FIG. 1E |
| Mauritania | 220 V | 50 Hz | FIG. 1C |
| Mauritius | 230 V | 50 Hz | FIG. 1C, FIG. 1G |
| Mexico | 127 V | 60 Hz | FIG. 1A, FIG. 1B |
| Micronesia | 120 V | 60 Hz | FIG. 1A, FIG. 1B |
| Monaco | 127/220 V | 50 Hz | FIG. 1C, FIG. 1D, FIG. 1E FIG. 1F |
| Mongolia | 230 V | | FIG. 1C, FIG. 1E |
| Montserrat | 230 V | 60 Hz | FIG. 1A, FIG. 1B |
| Morocco | 127/220 V | 50 Hz | FIG. 1C, FIG. 1E |
| Mozambique | 220 V | 50 Hz | FIG. 1C, FIG. 1F, FIG. 1M |
| Myanmar | 230 V | 50 Hz | FIG. 1C, FIG. 1D, FIG. 1F, FIG. 1G |
| Namibia | 220 V | 50 Hz | FIG. 1D |
| Nauru | 240 V | 50 Hz | FIG. 1I |
| Nepal | 230 V | 50 Hz | FIG. 1C, FIG. 1D |
| Netherlands | 230 V | 50 Hz | FIG. 1C, FIG. 1F |
| Netherlands Antilles | 127/220 V | 50 Hz | FIG. 1A, FIG. 1B, FIG. 1F |
| St. Martin | 120 V | 60 Hz | |
| Saba, (St. Eustatius | 110 V | 60 Hz | FIG. 1A, maybe FIG. 1B |
| New Caledonia | 220 V | 50 Hz | FIG. 1F |
| New Zealand | 230 V | 50 Hz | FIG. 1I |
| Nicaragua | 120 V | 60 Hz | FIG. 1A |
| Niger | 220 V | 50 Hz | FIG. 1A, FIG. 1B, FIG. 1C, FIG. 1D, FIG. 1E, FIG. 1F |
| Nigeria | 240 V | 50 Hz | FIG. 1D, FIG. 1G |
| Norway | 230 V | 50 Hz | FIG. 1C, FIG. 1F |
| Okinawa | 100 V | 60 Hz | FIG. 1A, FIG. 1B, FIG. 1I |
| Oman | 240 V | 50 Hz | FIG. 1G |
| Pakistan | 230 V | 50 Hz | FIG. 1C, FIG. 1D |
| Palmyra Atoll | 120 V | 60 Hz | FIG. 1A, FIG. 1B |
| Panama | 110 V | 60 Hz | FIG. 1A, FIG. 1B |
| Panama City | 120 V | | |
| Papua New Guinea | 240 V | 50 Hz | FIG. 1I |
| Paraguay | 220 V | 50 Hz | FIG. 1C |
| Peru | 220 V | 60 Hz | FIG. 1A, FIG. 1B, FIG. 1C |
| Philippines | 220 V | 60 Hz | FIG. 1A, FIG. 1B, FIG. 1C |
| Poland | 230 V | 50 Hz | FIG. 1C, FIG. 1E |
| Portugal | 230 V | 50 Hz | FIG. 1C, FIG. 1F |
| Puerto Rico | 120 V | 60 Hz | FIG. 1A, FIG. 1B |
| Qatar | 240 V | 50 Hz | FIG. 1D, FIG. 1G |
| Réunion Island | 220 V | 50 Hz | FIG. 1E |
| Romania | 230 V | 50 Hz | FIG. 1C, FIG. 1F |
| Russian Federation | 220 V | 50 Hz | FIG. 1C |
| Rwanda | 230 V | 50 Hz | FIG. 1C, FIG. 1J |
| St. Kitts and Nevis | 230 V | 60 Hz | FIG. 1D, FIG. 1G |
| St. Lucia | 240 V | 50 Hz | FIG. 1G |
| St. Vincent | 230 V | 50 Hz | FIG. 1A, FIG. 1C, FIG. 1E, FIG. 1G, FIG. 1I, FIG. 1K |
| Saudi Arabia | 127/220 V | 60 Hz | FIG. 1A, FIG. 1B, FIG. 1F, FIG. 1G |
| Senegal | 230 V | 50 Hz | FIG. 1C, FIG. 1D, FIG. 1E, FIG. 1K |
| Serbia-Montenegro | 220 V | 50 Hz | FIG. 1C, FIG. 1F |
| Seychelles | 240 V | 50 Hz | FIG. 1G |
| Sierra Leone | 230 V | 50 Hz | FIG. 1D, FIG. 1G |
| Singapore | 230 V | 50 Hz | FIG. 1G Type FIG. 1A |
| Slovak Republic | 230 V | 50 Hz | FIG. 1E |
| Slovenia | 220 V | 50 Hz | FIG. 1C, FIG. 1F |
| Somalia | 220 V | 50 Hz | FIG. 1C |
| South Africa | 220/230 V | 50 Hz | FIG. 1M |
| Spain | 230 V | 50 Hz | FIG. 1C, FIG. 1F |
| Sri Lanka | 230 V | 50 Hz | FIG. 1D |
| Sudan | 230 V | 50 Hz | FIG. 1C, FIG. 1D |
| Suriname | 127 V | 60 Hz | FIG. 1C, FIG. 1F |
| Swaziland | 230 V | 50 Hz | FIG. 1M |
| Sweden | 230 V | 50 Hz | FIG. 1C, FIG. 1F |
| Switzerland | 230 V | 50 Hz | FIG. 1J Type FIG. 1C |
| Syria | 220 V | 50 Hz | FIG. 1C, FIG. 1E, FIG. 1L |
| Tahiti | 110/220 V | 60 Hz | FIG. 1A, FIG. 1B, FIG. 1E |
| Tajikistan | 220 V | 50 Hz | FIG. 1C, FIG. 1I |
| Taiwan | 110 V | 60 Hz | FIG. 1A, FIG. 1B |
| Tanzania | 230 V | 50 Hz | FIG. 1D, FIG. 1G |
| Thailand | 220 V | 50 Hz | FIG. 1A, FIG. 1C |
| Togo | 220 V | 50 Hz | FIG. 1C |
| Tonga | 240 V | 50 Hz | FIG. 1I |
| Trinidad, Tobago | 115 V | 60 Hz | FIG. 1A, FIG. 1B |
| Tunisia | 230 V | 50 Hz | FIG. 1C, FIG. 1E |
| Turkey | 230 V | 50 Hz | FIG. 1C, FIG. 1F |
| Turkmenistan | 220 V | 50 Hz | FIG. 1B, FIG. 1F |
| Uganda | 240 V | 50 Hz | FIG. 1G |

TABLE I-continued

| COUNTRY | VOLTAGE | FREQUENCY | PLUG |
|---|---|---|---|
| Ukraine | 220 V | 50 Hz | FIG. 1C |
| United Arab Emirates | 220 V | 50 Hz | FIG. 1C, FIG. 1D, FIG. 1G |
| United Kingdom | 230 V | 50 Hz | FIG. 1G |
| United States | 120 V | 60 Hz | FIG. 1A, FIG. 1B |
| Uruguay | 220 V | 50 Hz | FIG. 1C, FIG. 1F, FIG. 1I, FIG. 1L Type FIG. 1F |
| Uzbekistan | 220 V | 50 Hz | FIG. 1C, FIG. 1I |
| Vanuatu | 230 V | 50 Hz | FIG. 1I |
| Venezuela | 120 V | 60 Hz | FIG. 1A, FIG. 1B |
| Vietnam | 127/220 V | 50 Hz | FIG. 1A, FIG. 1C, FIG. 1G |
| Virgin Islands | 115 V | 60 Hz | FIG. 1A, FIG. 1B |
| Western Samoa | 230 V | 50 Hz | FIG. 1I |
| Yemen, Rep. of | 220/230 V | 50 Hz | FIG. 1A, FIG. 1D, FIG. 1G |
| Yugoslavia (Former) | 220 V | 50 Hz | FIG. 1C, FIG. 1F |
| Zambia | 230 V | 50 Hz | FIG. 1C, FIG. 1D, FIG. 1G |
| Zimbabwe | 220 V | 50 Hz | FIG. 1D, FIG. 1G |

Various prior art commercial products have attempted to deal with the problem of fitting at least the most popular power plugs. Some use the Swiss-Army-Knife approach in which various kinds of plugs can be flipped out of a body for use. The Belkin Universal AC Travel Adapter is one such example. Others supply a variety kit of individual adapters, for example, the Targus APK01US Travel Connection Pack for Europe. The Kensington Travel Plug Adapter fits a revolver-type barrel on the end of a power cord and several sliders allow the user to extend the right plug out the distal end for over 150 different countries.

What is needed is a simple power plug that can be fitted on a cord that can simply and quickly plug into whatever plug arrangement is available.

SUMMARY OF THE INVENTION

In an example embodiment of the present invention, a universal power plug comprises two plastic halves that are hinged together so they can open and close like a door hinge plate. Each half has a plug blade mounted in a cylindrical socket that allows them to freely rotate and best fit a particular wall socket. The hinged arrangement allows the pitch between the blades to be adjusted to accommodate the variety of blade and pin spacings used throughout the world for power plugs. A spring is provided between the housing halves to put pressure between the plug blade and receptacle contact when the housing halves are folded close together.

The above summary of the present invention is not intended to represent each disclosed embodiment, or every aspect, of the present invention. Other aspects and example embodiments are provided in the figures and the detailed description that follow.

BRIEF DESCRIPTION OF THE DRAWINGS

The invention may be more completely understood in consideration of the following detailed description of various embodiments of the invention in connection with the accompanying drawings, in which:

FIG. 2A shows the plug with its two housings folded a bit on their hinges to shorten the pitch P. FIG. 2B shows the plug in cutaway view and laid flat out to maximize the pitch P;

FIG. 3A shows the plug with its two housings folded a bit on their hinges to shorten the pitch P, and shows the action of the blade thumbwheels. FIG. 3B shows the plug adapter laid flat out to maximize the pitch P;

Figure 1A:
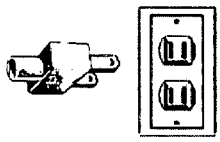
PRIOR ART Fig. 1A
FIG. 1A is a perspective diagram of the common types of power plugs used in American Samoa, Anguilla, Antigua, Aruba, Bahamas, Bangladesh, Barbados, Bermuda, Bolivia, Brazil, Cambodia, Canada, Cayman Islands, China, Colombia, Costa Rica, Cuba, Ecuador, El Salvador, Guam, Guatemala, Guyana, Haiti, Honduras, Jamaica, Japan, Laos, Lebanon, Liberia, Maldives, Mexico, Micronesia, Montserrat, Netherlands Antilles, Nicaragua, Niger, Okinawa, Panama, Peru, Philippines, Puerto Rico, St. Vincent, Saudi Arabia, Tahiti, Taiwan, Thailand, United States, Venezuela, Vietnam, Virgin Islands (U.S.& British), and Yemen.
Figure 1B:
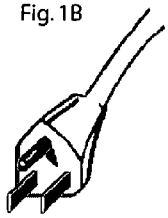
PRIOR ART Fig. 1B
FIG. 1B is a perspective diagram of the common types of power plugs used in American Samoa, Anguilla, Antigua, Aruba, Azores, Belize, Bahamas, Barbados, Bermuda, Brazil, Canada, Cayman Islands, Colombia, Costa Rica, Cuba, Ecuador, El Salvador, Guam, Guatemala, Guyana, Haiti, Honduras, Jamaica, Japan, Laos, Lebanon, Mexico, Micronesia, Montserrat, Netherlands Antilles, Nicaragua, Niger, Okinawa, Panama, Philippines, Puerto Rico, Saudi Arabia, Taiwan, Trinidad, Tobago, United States, Venezuela, and Virgin Islands.
Figure 1C:
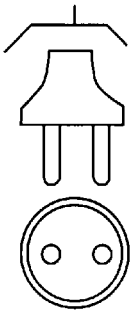
PRIOR ART Fig. 1C
FIG. 1C is a perspective diagram of the common types of power plugs used in Albania, Algeria, Angola, Argentina, Austria, Azores, Balearic Islands, Bangladesh, Belgium, Bolivia, Bosnia, Brazil, Bulgaria, Burkina Faso, Burundi, Cameroon, Canary Islands, Cape Verde, Central African Republic, Channel Islands, Chile, Comoros, Congo, Croatia, Dem. Rep. of Congo (Zaire), Cote d'Ivoire (Ivory Coast), Cyprus, Denmark, Djibouti, Egypt, El Salvador, Equatorial Guinea, Eritrea, Faeroe Islands, Finland, French Guiana, Gabon, Germany, Gibraltar, Greece, Greenland, Guadeloupe, Guinea, Guinea-Bissau, Hungary, Iceland, India, Indonesia, Iran, Iraq, Isle of Man, Israel, Italy, Kazakhstan, Korea, Kuwait, Laos, Lebanon, Lithuania, Luxembourg, Macedonia, Madagascar, Madeira, Mali, Martinique, Mauritania, Mauritius, Monaco, Morocco, Mozambique, Myanmar, Nepal, Netherlands, Niger, Norway, Oman, Pakistan, Paraguay, Peru, Philippines, Poland, Portugal, Romania, Russia, Rwanda, St. Vincent, Senegal, Serbia, Slovenia, Somalia, Spain, Sudan, Suriname, Sweden, Switzerland, Syria, Thailand, Togo, Tunisia, Turkey, Uruguay, Vietnam, Yugoslavia (former), and Zambia.
Figure 1D:
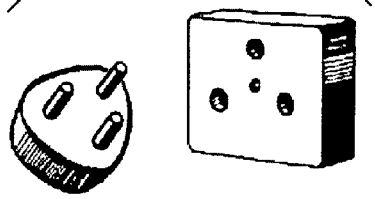
PRIOR ART Fig. 1D
FIG. 1D is a perspective diagram of the common types of power plugs used in Afghanistan, Bangladesh, Benin, Botswana, Cameroon, Chad, Dem. Rep. of Congo (Zaire), Dominica, Ecuador, El Salvador, Ethiopia, French Guiana, Ghana, Greece, Guadeloupe, Guyana, Hong Kong, India, Iraq, Jerusalem, Jordan, Kenya, Lebanon, Libya, Macao, Madagascar, Maldives, Martinique, Monaco, Myanmar (Burma), Namibia, Nepal, Niger, Nigeria, Pakistan, Qatar, St. Kitts-Nevis, Senegal, Sierra Leone, Sri Lanka, Sudan, Tanzania, United Arab Emirates, Yemen, Zambia, and Zimbabwe.
Figure 1E:
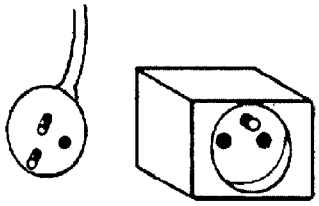
PRIOR ART Fig. 1E
FIG. 1E is a perspective diagram of the common types of power plugs used in Belgium, Burkina Faso, Burundi, Cameroon, Canary Islands, Central African Republic, Chad, Comoros, Congo, Cote d'Ivoire (Ivory Coast), Czech Republic, Djibouti, El Salvador, Equatorial Guinea, France, French Guiana, Greece, Guadeloupe, Ireland, Indonesia, Italy, Laos, Latvia, Lithuania, Madagascar, Mali, Martinique, Monaco, Morocco, Niger, Poland, St. Vincent, Senegal, Slovakia, Syria, Tahiti, and Tunisia.
Figure 1F:
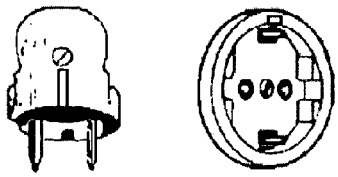
PRIOR ART Fig. 1F
FIG. 1F is a perspective diagram of the common types of power plugs used in Algeria, American Samoa, Aruba, Austria, Azores, Balearic Islands, Bosnia, Bulgaria, Cape Verde, Chad, Croatia, El Salvador, Finland, France, Germany, Greece, Guinea, Hungary, Iceland, Indonesia, Italy, Jordan, Korea, Laos, Luxembourg, Madeira, Monaco, Mozambique, Myanmar, Netherlands, Netherlands Antilles, Niger, Norway, Portugal, Romania, Suriname, Sweden, Turkey, Uruguay, and Yugoslavia (former)

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 1G:
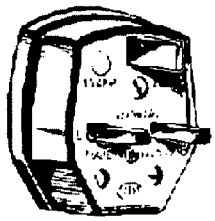
PRIOR ART Fig. 1G
FIG. 1G is a perspective diagram of the common types of power plugs used in Bahrain, Bangladesh, Belize, Botswana, Brunei, Cameroon, Channel Islands, China, Cyprus, Dominica, El Salvador, Gambia, Ghana, Gibraltar, Grenada, Guatemala, Guyana, Hong Kong, Iraq, Ireland, Isle of Man, Jordan, Kenya, Kuwait, Lebanon, Macau, Malawi, Malaysia, Maldives, Malta, Mauritius, Myanmar, Nigeria, Oman, Qatar, St. Kitts-Nevis, St. Lucia, St. Vincent, Saudi Arabia, Seychelles, Sierra Leone, Singapore, Tanzania, Uganda, United Arab Emirates, United Kingdom, Vietnam, Yemen, Zambia, and Zimbabwe.
Figure 1H:
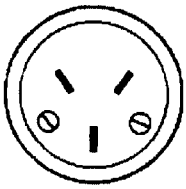
PRIOR ART Fig. 1H
FIG. 1H is a perspective diagram of the common types of power plugs used in Gaza and Israel.
Figure 1I:
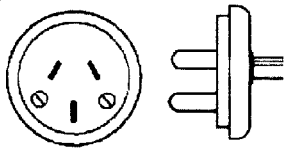
PRIOR ART Fig. 1I
FIG. 1I is a perspective diagram of the common types of power plugs used in American Samoa, Argentina, Australia, China, El Salvador, Fiji, Guatemala, Kiribati, Nauru, New Zealand, Okinawa, Panama, Papua New Guinea, St. Vincent, Tajikistan, Tonga, and Uruguay.
Figure 1J:
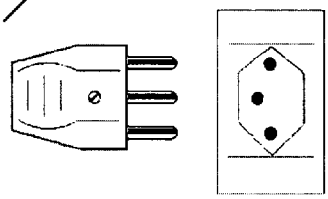
PRIOR ART Fig. 1J
FIG. 1J is a perspective diagram of the common types of power plugs used in El Salvador, Ethiopia, Madagascar, Maldives, Rwanda, and Switzerland.
Figure 1K:
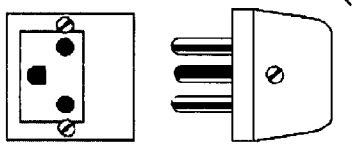
PRIOR ART Fig. 1K
FIG. 1K is a perspective diagram of the common types of power plugs used in Bangladesh, Denmark, Faeroe Islands, Greenland, Guinea, Madagascar, Maldives, St. Vincent, Senegal, and Tunisia.
Figure 1L:
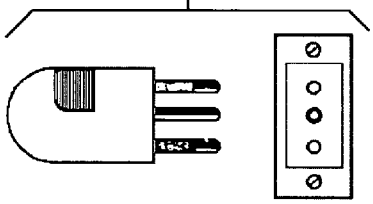
PRIOR ART Fig. 1L
FIG. 1L is a perspective diagram of the common types of power plugs used in Chile, Cuba, El Salvador, Ethiopia, Italy, Maldives, Syria, Tunisia, Uruguay.
Figure 1M:
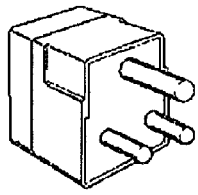
PRIOR ART Fig. 1M
FIG. 1M is a perspective diagram of the common types of power plugs used in Mozambique, South Africa, and Swaziland.
Figure 2A:
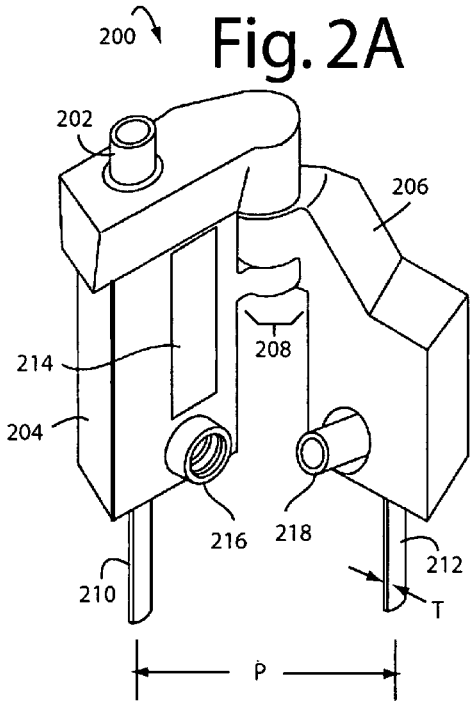
FIGS. 2A and 2B are perspective diagrams of a universal power plug embodiment of the present invention.
Figure 2B:
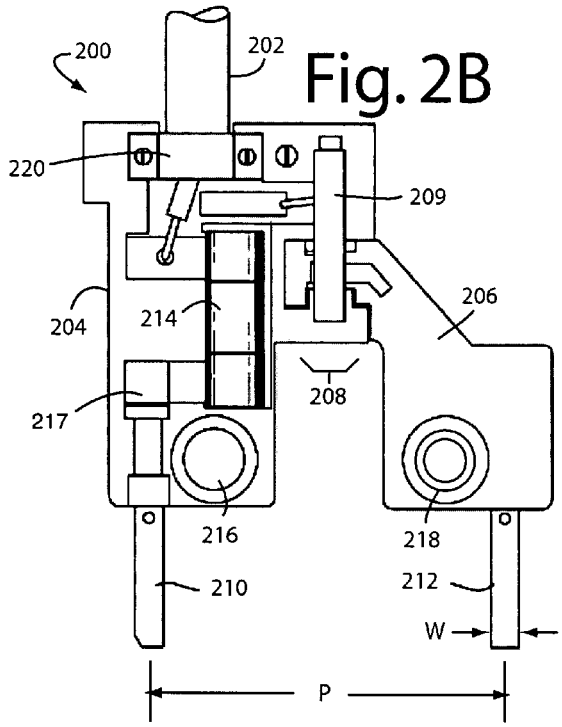

FIGS. 2A and 2B represent a universal 2-wire power plug embodiment of the present invention, and is referred to herein by the general reference numeral 200. Plug 200 will fit many of the applications illustrated in FIGS. 1A-1M by virtual of its being able to accommodate just about all of the variations in plug blade/pin spacings. A power cord 202 is attached to a left plastic housing 204. A matching right plastic housing 206 is attached by a hinge 208 and a pin 209, and the two housings are able to open and close like a clamshell. Pin 209 is conductive, and allows one half of the mains current to be connected from power cord 202 to plug blade 212.

The hinged arrangement between the housing halves allows the pitch (P) between a pair of plug blades 210 and 212 to be adjusted by the user to fit a particular wall socket. A fuse 214 protects the plug from carrying too much current, e.g., 15 A. A spring 216 and spring seat 218 apply outward pressures on the plug blades 210 and 212 in a wall socket when the two housings 204 and 206 are closed together. This helps maintain electrical contact with the wall socket.

The plug blades 210 and 212 each have a width (W) and thickness (T) chosen to fit within a variety of round, square, and rectangular cross-section socket holes. A cylindrical socket 217, for example, allows plug blade 210 to freely rotate to best fit any socket the user plugs it into. Plug blade 212 is similarly equipped. A strain relief 220 anchors power cord 202 to the left housing 204.

Figure 3A:
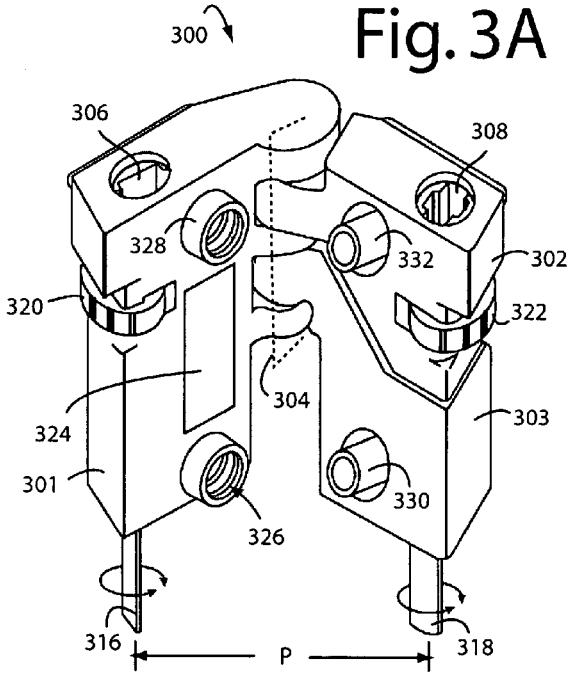
FIGS. 3A and 3B are perspective diagrams of a universal power plug adapter embodiment of the present invention.
Figure 3B:
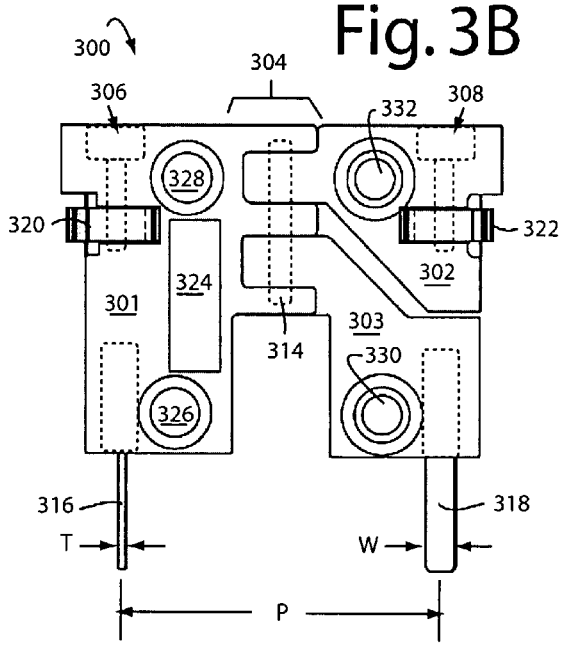

FIGS. 3A and 3B represent a universal 2-wire power plug adapter embodiment of the present invention, and is referred to herein by the general reference numeral 300. Plug 300 will adapt a variety of existing cord plugs to many of the applications illustrated in FIGS. 1A-1M. It can do this for both the plugs it receives as well as the sockets it plugs into by being able to independent accommodate just about all of the variations in plug blade/pin spacings. A left housing 301 is able to fold together with an upper right housing 302 and a lower right housing 303. These are typically plastic shells that enclose the utility voltage conductors inside and are joined together by a hinge 304. A pair of universal sockets 306 and 308 are respectively disposed in the top ends of left and top right plastic housings 301 and 302. A pair of thumbwheels 320 and 322 allow the user to independently rotate sockets 306 and 308 so they can best accommodate an appliance cord plug. The sockets 306 and 308 have contact openings resembling a fat squat "+" sign such that they can accept and make good contact with any of the flat or square blades, or round pins on the plugs illustrated in FIGS. 1A-1M.

Hinge 304 has two parts connected by a single conducting hinge pin 314. This arrangement allows the top right housing 302 to be folded with respect to the left housing 301 to adjust the pitch (P) between sockets 306 and 308 to accept the appliance cord plug pins/blades. The arrangement also allows the bottom right housing 303 to be folded with respect to the left housing 301 to adjust the pitch (P) between a pair of plug blades 316 and 318. Each of the plug blades 316 and 318 is mounted in a cylindrical joint that allows them to be rotated for a proper fit with a wall socket.

Socket 306 can be rotated by a thumbwheel 320, and the opposite socket 308 can be similarly rotated by a corresponding thumbwheel 322. Adapter 300 therefore allows the pitch (P) and orientation between the sockets 306 and 308 in the top to be adjusted to accommodate a particular plug, and the plug blades 316 and 318 in the bottom to independently accommodate a different type wall socket even though the plug types are very different. During travel, the whole may be laid open flat to save space and fit better in luggage.

A fuse 324 protects the plug from carrying too much current, e.g., 15A. A pair of springs 326 and 328 mate with a corresponding pair of spring seats 330 and 332 to apply an outward pressure on the plug blades 316 and 318 in a wall socket when the two right housings 302 and 303 are closed together with left housing 301. This helps maintain electrical contact with the appliance cord plug and the wall socket. In plug 300, hinge pin 314 is required to conduct one side of the mains current through it.

Figure 4:
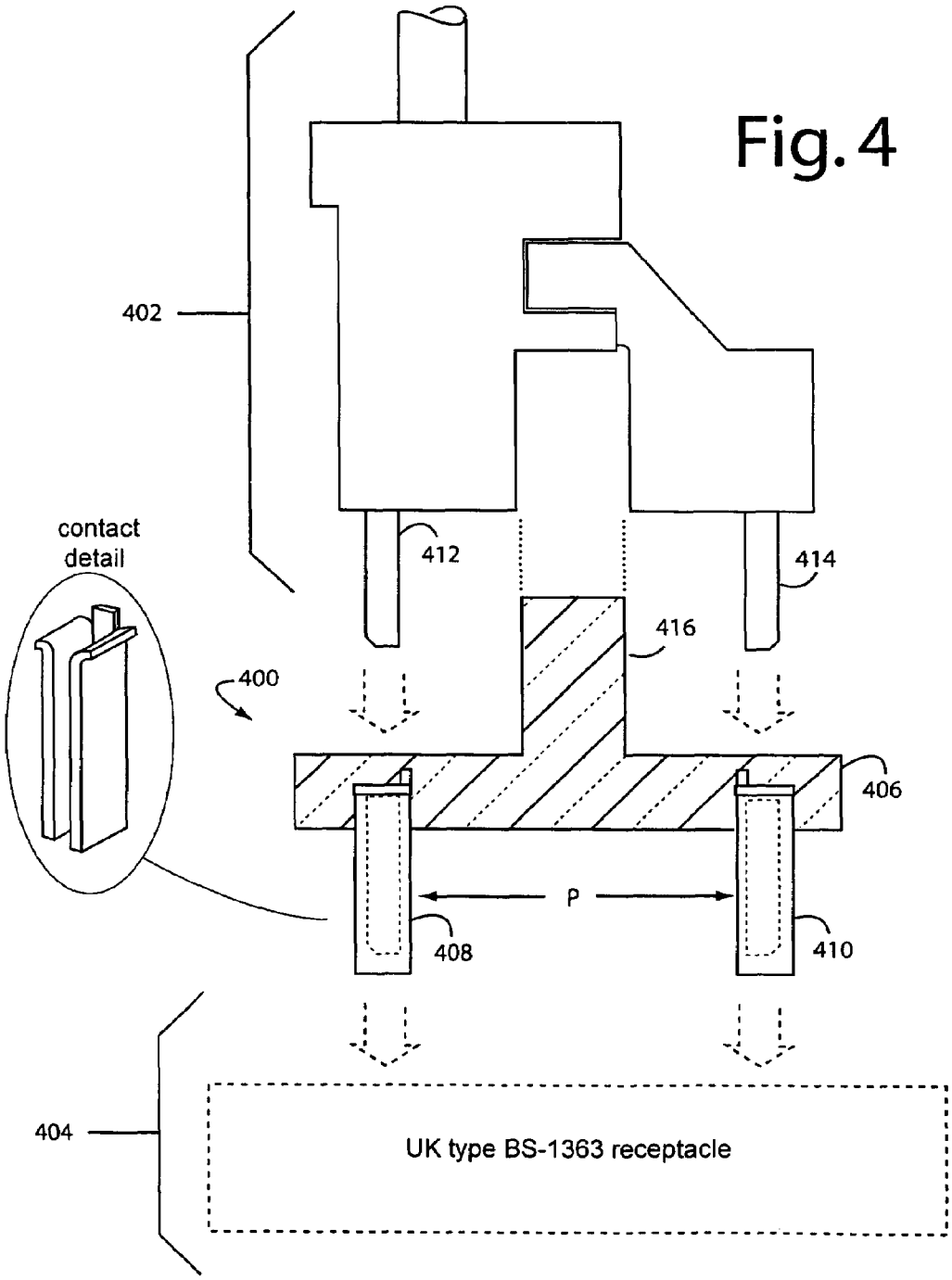
FIG. 4 is a cutaway diagram of a UK type BS-1363 adapter for the plug of FIGS. 2A and 2B, and the adapter of FIGS. 3A and 3B, and shows these in assembly view with a perspective detail of one contact pin.

FIG. 4 represents a BS-1363 type receptacle adapter embodiment of the present invention, and is referred to herein by the general reference numeral 400. The standard 13-amp BS-1363 plug for such receptacle is represented in FIG. 1G, and has very large squared plug pins, e.g., 6.35 mm square. The plug pins of plug 200 and plug adapter 300 (FIGS. 2 and 3) will typically only be 1.5 mm by 4.0 mm. The difference in fit needs to be made up by adapter 400. A universal plug 402 is like those of plug 200 and adapter 300 (FIGS. 2 and 3), and is plugged by a user into a UK type BS-1363 receptacle 404. To do this, adapter 400 includes an insulated body 406 that allows a user to safely insert brass power pins 408 and 410 into a live BS-1363 receptacle 404. The "contact detail" in FIG. 4 shows, in perspective view, how power pins 408 and 410 may be constructed. The body 406 can comprise plastic, ceramic, or other material strong enough to withstand the forces applied when plugging in, and that allows the tops of power pins 408 and 410 to be molded in place. In use, universal plug pins 412 and 414 are inserted into adapter power pins 408 and 410, and the whole into the BS-1363 receptacle 404. A tab 416 allows the user to withdraw the adapter from BS-1363 receptacle 404 after universal plug 402 has been withdrawn.

The BS-1363 type plug shown in FIG. 1G can be accommodated directly by the top receptacle part of plug adapter 300 (FIG. 3). No other adapter is necessary.

While the present invention has been described with reference to several particular example embodiments, those skilled in the art will recognize that many changes may be made thereto without departing from the spirit and scope of the present invention, which is set forth in the following claims.

The invention claimed is:

1. A universal power plug, comprising:

a pair of folding left and right body parts connected together with a hinge;

a pair of freely rotating plug blades each disposed in the bottom ends of the folding left and right parts; and wherein the combination of the folding left and right body parts, and the freely rotating plug blades makes a variety of wall socket types compatible.

2. The universal power plug of claim 1, further comprising:

a power cord and strain relief for supplying utility mains power to an appliance.

3. The universal power plug of claim 1, further comprising:

springs providing for exerting enough contact pressure between plug blades and a receptacle's contacts to automatically adjust their pitch.

4. The universal power plug of claim 1, further comprising:

an upper right body part connected by its own hinge to the left body part for independent motion; and a pair of sockets each disposed in a top end of the left and upper right body parts;

wherein an appliance power plug may be accommodated by the pair of sockets, and the freely rotating plug blades may be accommodated by a wall socket of a different type.

5. The universal power plug of claim 1, further comprising:

a hinge pin disposed in the left body part and providing for electrical current to be passed through the hinge to one of the freely rotating plug blades.

6. The universal power plug of claim 4, further comprising:

a pair of thumbwheels connected to the pair of sockets each disposed in a top end of the left and upper right body parts, and providing a way for the user to adjust how contact is made with said appliance power plug.

7. A method of making an electrical appliance plug universal for use in many of the worlds countries, comprising:

swivel-mounting each of two power plug blades or pins in a plastic plug body; and articulating said swivel-mounting of said plastic plug body such that it can fold open or closed with the effect of adjusting the pitch between the two power plug blades or pins;

wherein, a variety of power plug blade angles and spacings are accommodated for universal use in many of the worlds countries.

* * * * *